US005628606A

United States Patent [19]

Herzog et al.

[11] Patent Number: 5,628,606

[45] Date of Patent: *May 13, 1997

[54] LOADING/UNLOADING APPARATUS FOR RAILROAD CARS

[75] Inventors: William E. Herzog; Stanley M. Herzog; Randy L. Poggemiller, all of St. Joseph, Mo.

[73] Assignee: Herzog Contracting Corporation, St. Joseph, Mo.

[ * ] Notice: The term of this patent shall not extend beyond the expiration date of Pat. No. 5,527,144.

[21] Appl. No.: 603,285

[22] Filed: Feb. 20, 1996

Related U.S. Application Data

[63] Continuation-in-part of Ser. No. 339,752, Nov. 15, 1994, Pat. No. 5,527,144.

[51] Int. Cl.[6] ..... B65G 67/24

[52] U.S. Cl. ..... 414/339; 414/394; 414/718; 414/724

[58] Field of Search ..... 414/339, 345, 414/346, 539, 540, 541, 542, 543, 546, 549, 550, 390, 391, 392, 393, 394, 718, 724

[56] References Cited

U.S. PATENT DOCUMENTS

| | | |
|---|---|---|
| 1,263,170 | 4/1918 | Webb . |
| 1,361,832 | 12/1920 | Crilly . |
| 1,678,245 | 7/1928 | Dickenson et al. . |
| 2,801,014 | 7/1957 | Colson . |
| 3,107,803 | 10/1963 | Glosup et al. . |
| 3,329,289 | 7/1967 | Fritz . |
| 3,376,988 | 4/1968 | Klosk . |
| 3,881,612 | 5/1975 | Wells . |
| 4,096,954 | 6/1978 | Buckner . |
| 4,099,635 | 7/1978 | Leonard et al. . |
| 4,128,180 | 12/1978 | Mellious . |
| 4,175,902 | 11/1979 | Herzog et al. . |
| 4,190,394 | 2/1980 | Herzog et al. . |

FOREIGN PATENT DOCUMENTS

| | | |
|---|---|---|
| 1481286 | 2/1969 | Germany . |
| 1017629 | 5/1983 | U.S.S.R. . |

OTHER PUBLICATIONS

Statement of Herzog Contracting Corp.'s "History of the Center Beam Support Development in Railroad Car Loader/Unloader" with attached drawings and photographs as exhibits thereto.

*Primary Examiner*—Frank E. Werner

*Attorney, Agent, or Firm*—Litman, McMahon and Brown, L.L.C.

[57] ABSTRACT

An improved railroad car loader/unloader apparatus includes a backhoe-type machine adapted to operate atop an open top railroad car. The apparatus includes front and rear support feet and a center support beam to which are pivotally attached a pair of center support feet, one to either end of the center support beam with each of the feet contacting an upper surface of the sidewalls of the railroad car. Each center support foot is pivotable through a horizontal plane between extended support position and a retracted, stored position. In one alternative version, double action hydraulic piston and cylinder units are provided to selectively extend and retract the center support feet.

13 Claims, 5 Drawing Sheets

LOADING/UNLOADING APPARATUS FOR RAILROAD CARS

CROSS REFERENCE TO RELATED APPLICATIONS

This application is a continuation-in-part of application Ser. No. 08/339,752, filed Nov. 15, 1994, now U.S. Pat. No. 5,527,144 and entitled IMPROVED LOADING/UNLOADING APPARATUS FOR RAILROAD CARS.

BACKGROUND OF THE INVENTION

1. Field of the Invention

The present invention relates to an improved apparatus for loading and unloading railroad cars, and more particularly to such an apparatus in which an articulating center support assembly is provided for added stability. An alternative embodiment of the center support assembly incorporates hydraulic piston and cylinder units for selective extension and retraction of center support feet.

2. Description of the Related Art

Loading and unloading of open top railroad cars has traditionally been accomplished via large, fixed base cranes or similar systems stationed alongside a railroad depot. However, loading, or particularly unloading, must often be accomplished at a site remote from such a depot, such as during handling of cross-ties and track bed ballast for railroad construction or repair. Traditionally such unloading tasks have been accomplished via manual labor or by transporting large, highly specialized and expensive equipment to the job site. The disadvantages of manual labor are, of course, many, including lack of efficiency and added expense. On the other hand, the costs of purchasing or renting expensive specialized equipment and the costs of transporting the equipment to each job site can also be prohibitive.

U.S. Pat. No. 4,175,902 entitled APPARATUS FOR LOADING AND UNLOADING RAILROAD CARS (the '902 patent) and 4,190,394 entitled METHOD FOR LOADING AND UNLOADING RAILROAD CARS (the '394 patent) to Stanley Herzog et al. are directed to an apparatus and method, respectively, of employing a specially adapted backhoe-like machine which has the capability to load or unload open top railroad cars. In these patents, which are hereby incorporated herein by reference, the specially adapted backhoes, called "Cartoppers™", can be easily transported to remote sites, where they are capable, with a trained operator and a front bucket mounted winch, of loading themselves onto the top of the railroad car. The machines can then be moved along the top of each railroad car as material, such as track ballast, railroad ties, coal, or other materials are unloaded from, or loaded onto the railroad car. The machines, when not employed in loading or unloading railroad cars, are versatile enough to be quickly converted for use in ordinary tasks such as digging, trenching, etc. which are unrelated to the loading or unloading tasks. However, a problem encountered with the original design, which had supports attached only to the front bucket and to the chassis behind the operator's cab, was the lack of stability when the machine was positioned atop a railroad car. Center support feet were added to the machines to increase stability, but deployment of these center feet involved heavy manual lifting or, in later horizontal versions, much manual tugging and pushing, with consequent potential danger and injury to equipment operators.

It is clear then, that a need exists for improving the loading/unloading apparatus described in the '902 and '394 patents, as well as the parent application, to limit or eliminate manual labor in deploying center support feet.

SUMMARY OF THE INVENTION

The present invention is directed to an improved apparatus for loading and unloading railroad cars. The apparatus includes a backhoe-type machine of the type taught in the '902 patent, which has been highly modified for positioning atop and loading or unloading open top railroad cars. As in the '902 patent, the machine has conventional front and rear boom structures, with the front boom modified to include a winch. A pair of front support feet are attached to the front bucket and a pair of rear support feet are attached to a corresponding pair of swingable outrigger arms on the backhoe chassis behind the operator's cab with the front and rear support feet resting on and overhanging the upper surfaces of the railroad car sidewalls when the apparatus is positioned atop it. By coordinated use of the front and rear booms, support feet and winch, the apparatus can be elevated from a position adjacent one end of the railroad car to a position atop the railroad car without the aid of other machinery or cranes. The present invention includes a center support assembly positioned between the front and rear axles of the machine. The inventive center support assembly includes a support beam which extends transversely across and is attached to the underneath side of the chassis just behind the front wheels. The center support beam is removably attached to the bottom of the chassis via a support gusset and a plurality of bolts and extends outward past the wheels on either side. A pair of articulating support feet are pivotally attached, one to either end of the center support beam. Each of the support feet is movable between an extended position, in which the respective feet extend outward in line with the support beam, and a retracted position, in which each foot extends rearward at approximately right angles with respect to the center support beam. In the extended position, the center support feet provide additional support for the machine when it is positioned atop a railroad car, while in the retracted position, the machine can be used for ordinary tasks unrelated to railroad car loading and unloading, or can be placed inside a railroad car for transport.

In an alternative version, each center foot is selectively extendable and retractable via a hydraulic piston and cylinder unit which has one end eccentrically attached to the support foot and has a second end pivotally attached to the chassis body.

OBJECTS AND ADVANTAGES OF THE INVENTION

Objects and advantages of the present invention include: providing an improved railroad car loader/unloader apparatus; providing such a loader/unloader apparatus with improved stability and versatility; providing such an apparatus with a center support assembly including a removable center support beam and a pair of horizontally oriented center support feet which are attached to the center support beam and which are pivotable between retracted and extended, locked positions; providing such an apparatus with hydraulic piston and cylinder units for selectively extending and retracting the center support feet; and to provide such an apparatus which is durable and reliable and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
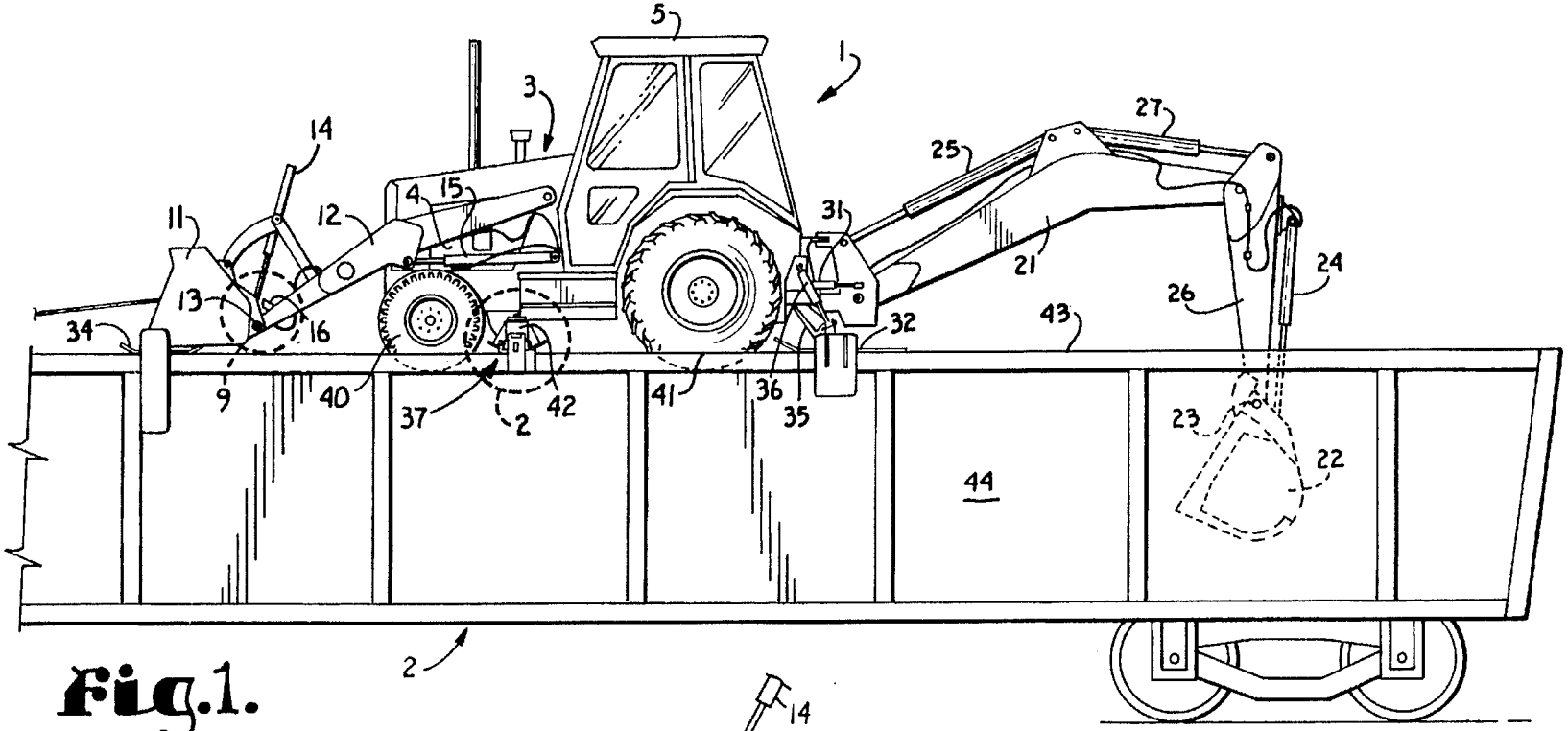
FIG. 1 is a side elevational view of a loading/unloading apparatus in position atop an open top railroad car, with portions of a rear bucket inside the car shown in phantom lines.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "up", "down", "right" and "left" will refer to directions in the drawings to which reference is made. The words "inward" and "outward" will refer to directions toward and away from, respectively, the geometric center of the embodiment being described and designated parts thereof. Said terminology will include the words specifically mentioned, derivatives thereof and words of a similar import.

Referring to the drawings in more detail, a loader/unloader apparatus in accordance with the present invention is generally indicated with the numeral 1. The apparatus 1 is shown positioned atop a conventional open top railroad car 2 for loading or unloading operations.

The apparatus 1 resembles a conventional backhoe including a central chassis portion 3 with an engine 4 and an operator's cab 5. The apparatus 1 includes a front bucket 11 supported by an articulating front bucket support boom 12. The front bucket 11 is pivotally attached to the front end of the boom 12 via a pivot mount 13. The bucket 11 is selectively pivotable about the pivot mount 13 via a front bucket hydraulic drive cylinders 14, and the front boom is selectively movable via a front boom hydraulic cylinder 15. A front bucket limit stop 16 is attached to the front boom 12, and is more particularly described later with respect to FIG. 9.

The apparatus 1 includes a rear articulating boom 21 to which is attached a rear bucket 22 via a pivot mount 23. The rear bucket 22 is selectively pivotable about the pivot mount 23 via a rear bucket hydraulic arm 24. The rear boom 21 can be selectively raised and lowered via a lifting hydraulic cylinder 25 and a rear pivot arm 26 can be selectively pivoted upward and downward via a rear pivot hydraulic cylinder 27. The rear boom 21 is also selectively movable from side to side via a matching pair of hydraulic cylinders 31. While shown with a rear bucket 22, other tools can be attached to the rear boom 21, including powered grappling hooks for lifting railroad ties, etc., as shown in the '902 and '394 patents.

In adapting the apparatus 1 for use as a loader/unloader, a pair of rear support feet 32 are attached to the chassis 3 behind rear wheels 33 and a pair of front bucket support feet 34 are attached, one to either side of the front bucket 11. The rear support feet 32 are selectively pivotable in and out and up and down via pivotable outrigger arms 35 and hydraulic cylinders 36. In addition, in the inventive apparatus 1, a center support assembly, generally indicated as 37, includes a center support beam 38 (FIG. 3) which is attached to the chassis 3 between front wheels 40 and rear wheels 41. A pair of articulating center support feet 42 are attached, one to either side of the center support beam 38. The front bucket support feet 34, the rear support feet 32 and the center support feet 42 are each designed and positioned to rest on an upper surface 43 of either sidewall 44 of the railroad car 2. The center support beam 37 is better illustrated in FIGS. 2–5.

II. Center Support Assembly

Referring to FIGS. 2–5, the center support assembly 37 includes the center support beam 38, which is welded or otherwise fixedly secured to the underside of the chassis 3. For further reinforcement, a vertical L-shaped gusset 45 extends upward from the beam 38 and the gusset 45 is also attached to the chassis 3 via a plurality of bolts 46 extending through bores (not shown) in the chassis 3. Since the beam 38 is attached by a plurality of bolts 46, it is readily removable from the chassis 3 if additional ground clearance is needed for operations other than loading and unloading. A pin keeper sleeve 47 is attached to the vertical plate 45 for retaining a pin 48 attached to a chain 49. Each end of the beam 38 is beveled at a 45 degree angle, as indicated at 51 in FIG. 5. Within each beveled end 51, a sleeve 52 extends from the top to the bottom of the beam 38. A bore 53 extends through the beam 38 from side to side.

Figure 2:
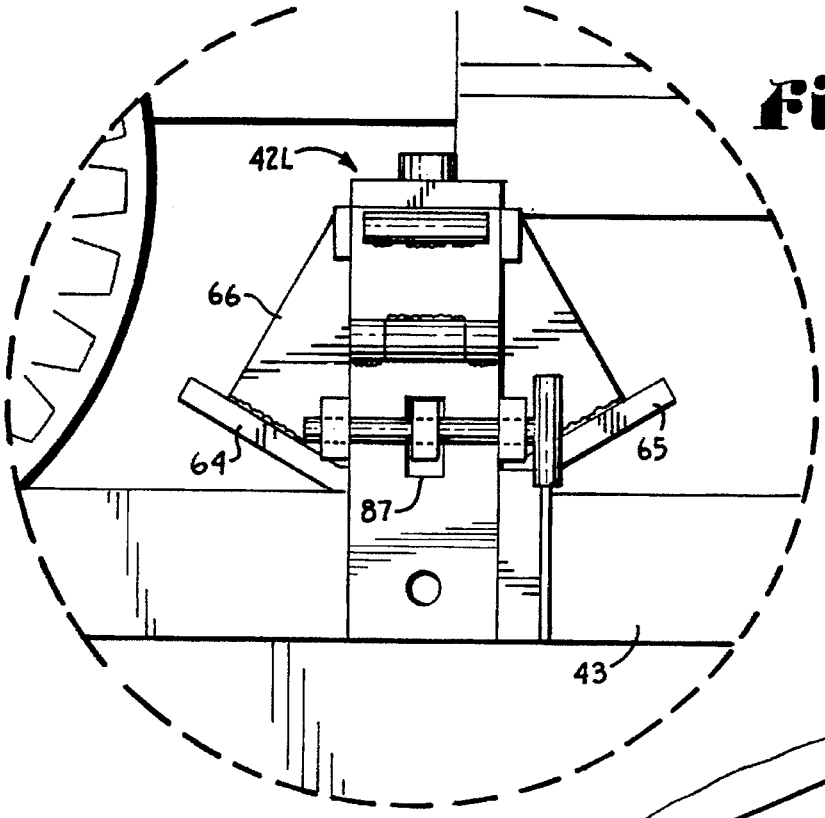
FIG. 2 is a greatly enlarged view of the area marked "2" and delineated in circular dotted lines in FIG. 1, illustrating an end-on view of a left side center support foot.
Figure 3:
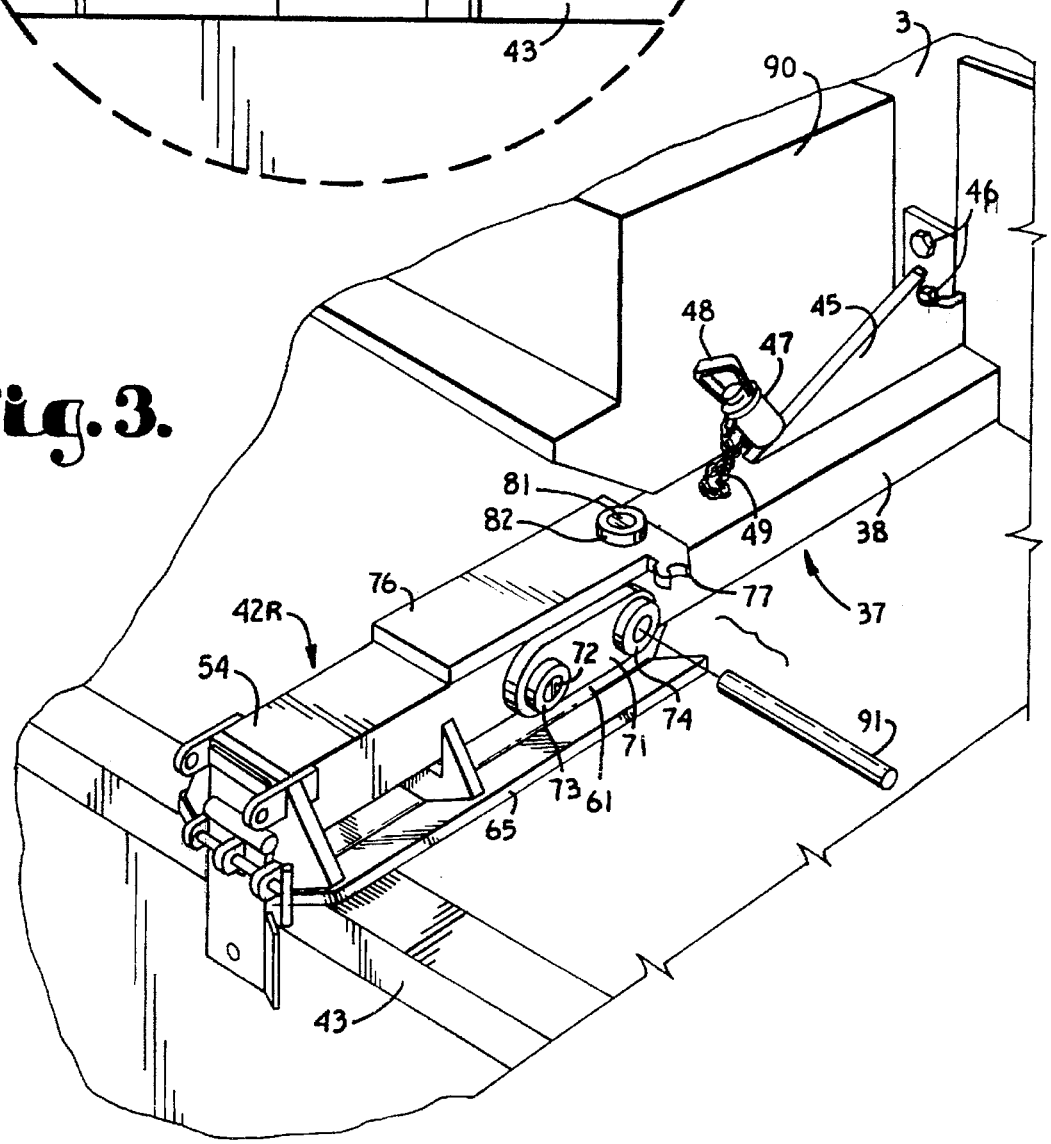
FIG. 3 is an enlarged, fragmentary, perspective view of the center support assembly including the right center support foot and a portion of the center support beam, with the right support foot in an extended position, with a pair of locking ears in a locking position, and with a vertical support plate pivoted downward to a support position.
Figure 4:
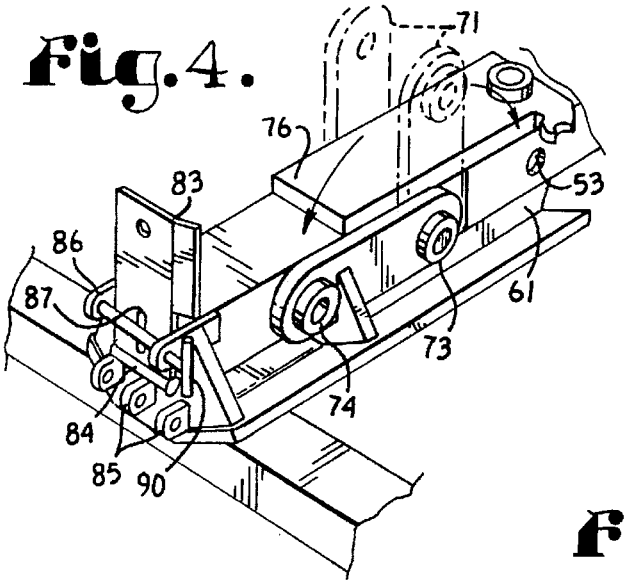
FIG. 4 is an enlarged, fragmentary, perspective view of the right center support foot of FIG. 3, shown in an unlocked, extended position with a locking ear pair shown in phantom lines in transition between a locking position and an unlocked position, and shown in the unlocked position in solid lines, and with the vertical support plate pivoted upward to a retracted position.
Figure 5:
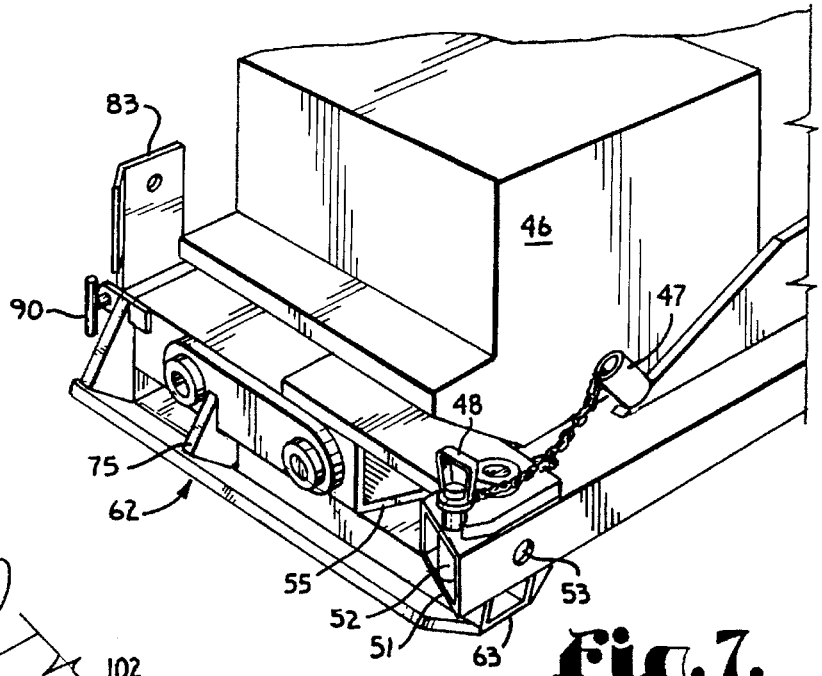
FIG. 5 is an enlarged, fragmentary, perspective view of the right center support foot of FIG. 3, shown in a retracted position with a locking pin inserted into the end of the center support beam to maintain the support foot in the retracted position.

The center support feet 42 are also illustrated in FIGS. 2–5. FIG. 2 shows the left side foot 42L while FIGS. 3–5 illustrate the right side foot 42R, it being understood that the right and left feet 42R and 42L, respectively, are mirror images of each other and component parts will be similarly numbered.

Each center support foot 42 includes a square steel tube 54 which is the same dimensions in cross-section as the center support beam 38. Each tube 54 has an end 55 which is also beveled at a 45 degree angle to mate with the respective beveled end 51 of the center beam 38. A section of rectangular tube 61 extends along the length of and past each tube 54 and is welded beneath each tube 54. A skid plate 62 is attached beneath each rectangular tube 61 with each skid plate 62 including a flat center portion 63 and a pair of angled wing portions 64 and 65. A skid reinforcing plate 66 extends upward and inward between the skid plate 62 and the tube 54 to provide enhanced support for the skid plate 62.

A pair of locking ears 71 are pivotably attached, one to either side of each tube 54 via a pivot shaft 72 extending through a bore (not shown) in the tube 54. Each locking ear 71 includes a pair of reinforced bores 73 and 74, with the bore 73 receiving the pivot shaft 72. A locking ear retainer 75 is attached to each tube 54 for retaining the ears 71 when in an unlocked position, as shown in FIG. 5.

Each center support foot 42 includes an upper pivot plate 76 which is attached to the top of and extends past the beveled end 55 of the respective tube 54. Each pivot plate 76 terminates in a pin receiving fork 77. A pivot pin 81 extends vertically through a reinforced bore 82 in each pivot plate 76, through a vertical bore (not shown) in the center support beam 38 and into the respective rectangular tube 61. Each support foot 42 is thus pivotably attached to a respective end of the center support beam 38 via the respective pivot pin 81.

A vertical support plate 83 is pivotably attached to the end of the skid reinforcing plate 66 via a pivot arm 84. A plurality of locking pin receiving extensions 85 are attached near the bottom of the reinforcing plate 66 and a second plurality of pin receiving extensions 86 are attached near the top of the reinforcing plate 66. A slot 87 is provided in the plate 83 to receive the center pin receiving extension 85 when the plate 83 is in the down, extended position. A locking pin 88 is adapted to be alternatively received by bores in either the extensions 85 or the extensions 86.

In operation, each of the center support feet 42R and 42L are pivotable to a retracted position, as shown in FIG. 5, in which the respective support foot 42 extends approximately parallel to the chassis 3 and partially underlies a step 90. In this position, the latching pin 48 is inserted into the sleeve 52 and the pin receiving fork 77 in the pivot plate 76 to retain the foot 42 in the retracted position. In the retracted position, the apparatus 1 can be utilized for work which is unrelated to loading or unloading railroad cars, or the apparatus 1 can be transported inside of a railroad car, such as the car 2.

When the apparatus 1 is to be used atop the railroad car 2, the pin 48 is removed and placed in the pin keeper 47 and each support foot 42 is pivoted outward 90 degrees to the extended position shown in FIGS. 2–4. The locking ear pairs 71 are then flipped 180 degrees from the unlocked position shown in FIG. 4 to the locking position shown in FIG. 3. In the locking position, the reinforced bores 74 in the ears 71 are aligned with the horizontal bores 53 in the support beam 38 and a locking pin 91 can be inserted therethrough to lock the feet 42 in place. Once the feet 42 are locked in the extended position, the pin 88 is removed from the top extensions 86, as shown in FIG. 4, and the vertical support plate 83 is allowed to rotate 180 degrees to the down position shown in FIGS. 2 and 3. The pin 88 is then reinserted into the lower extensions 85, thus locking the plate 83 in the extended position overlying the sidewalls 44 of the railroad car 2. With the center support feet 42 extended, as well as the front and rear support feet 34 and 32, respectively, and with the vertical plates 83 thus locked down, the apparatus 1 rests securely on the car 2 and is prevented from shifting from side to side.

II. Alternative Embodiment of Center Support Feet

Figure 6:
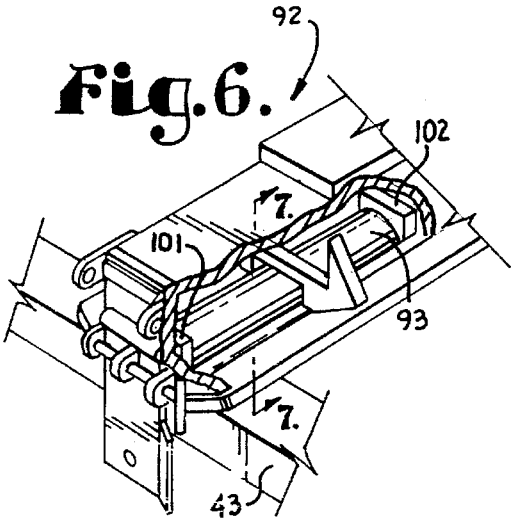
FIG. 6 is an enlarged, fragmentary, perspective view of an alternative embodiment of the right center support foot, shown in an extended position with portions broken away to illustrate a support roller.
Figure 7:
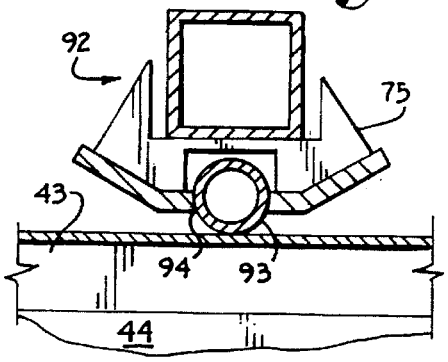
FIG. 7 is an enlarged, fragmentary, cross-sectional view of the right center support foot of FIG. 6, taken along line 7—7 of FIG. 6, again illustrating the support roller.

Referring to FIGS. 6 and 7, an alternative embodiment of center support foot is indicated generally with the numeral 92, it being understood again, that there are right and left mirror image support feet 92 on the apparatus 1. The support foot 92 differs from the support feet 42 of FIG. 2–5 in the provision of a support roller 93 which is positioned in a slot 94 in the bottom of skid 95. A pair of press fit bearings 101 and 102 are attached to the underneath side of the foot 92 and the roller 93 extends therebetween via a roller shaft (not shown). FIG. 7 illustrates the support of the foot 92 atop the upper surface 43 of the railroad car sidewalls 44 via the roller 93 to facilitate movement of the apparatus 1 along the top of the railroad car 2.

III. Alternative Embodiment of Front Support Feet

Figure 8:
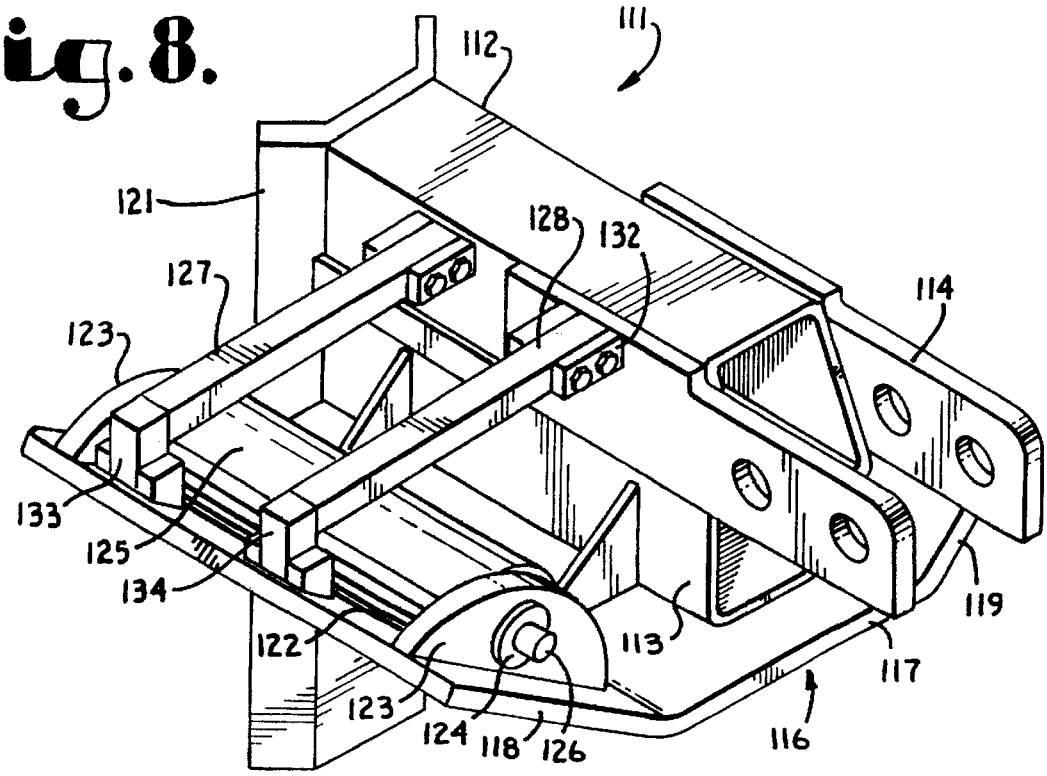
FIG. 8 is an enlarged, perspective view of an alternative embodiment of a front bucket support foot, illustrating a support roller.

Referring to FIG. 8, an alternative embodiment of a front support foot 111 is illustrated. The front support foot 111 includes an upper and a lower square steel tube 112 and 113, respectively, on an inner end to which are affixed a pair of support brackets 114 for attachment to the side of the front bucket 11 (FIG. 1). A skid 116 is affixed beneath the lower tube 113 with the skid 116 including a flat center portion 117 and a pair of angled wing portions 118 and 119. A vertical support plate 121 is attached to the outer end of the tube 112. In the wing portion 118, a slot 122 is formed and a pair of semi-circular bearing support plates 123 are attached to the wing portion 118 above respective ends of the slot 122. Each support plate 123 supports a bearing 124. A support roller 125 is suspended between the two bearings 124 via a roller shaft 126 and extends through the slot 122. A pair of support arms 127 and 128 extend between brackets 131 and 132, respectively on the upper tube 112 and a pair of brackets 133 and 134 on the upper side of the wing portion 118 to give enhanced rigidity to the wing portion 118.

Figure 10:
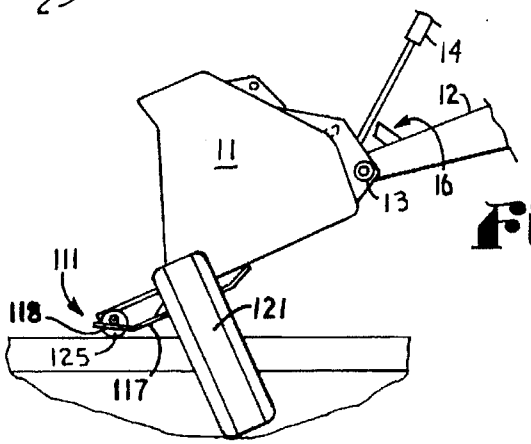
FIG. 10 is a partially schematic view of the rear support foot of FIG. 8, shown pivoted to a position in which the support roller contacts the upper surface of the railroad car sidewall.

In operation, as shown in FIG. 10, when the apparatus 1 is to be moved atop the railroad car 2, the hydraulic cylinder 14 is extended, causing the front bucket 11 to pivot forward. The attached front support feet 111 are thus also pivoted forward to a position in which the wing portion 118, and thus the roller 125, contacts the upper portions 43 of the railroad car sidewalls 44. When the apparatus 1 reaches the desired location on the railroad car 2, the hydraulic cylinder 14 is again retracted, rotating the front bucket 11 and the front support foot 111 backward to remove the roller 125 from contact and place the center portion 116 into contact with the upper surface 43 of the railroad car sidewall 44, thus stabilizing the apparatus 1 atop the railroad car 2.

IV. Retractable Front Bucket Stop

When the apparatus 1 is in use as a loader/unloader, the front bucket 11 is placed in a level position to place the front feet 34 or 111 in stable contact with the upper surfaces 43 of the railroad car sidewalls 44. With rear bucket loading and unloading operations, a large force is exerted against the front bucket 11 by the front support feet 34 or 111, which force tends to pivot the bucket 11 backward from the level position against the action of the hydraulic cylinder 14. With ordinary bucket operating hydraulics, these forces acting against the hydraulic cylinder 14 would quickly cause excess wear on the cylinder 14. Thus, additional support is required to hold the front bucket 11 in a position in which it is level.

Figure 9:
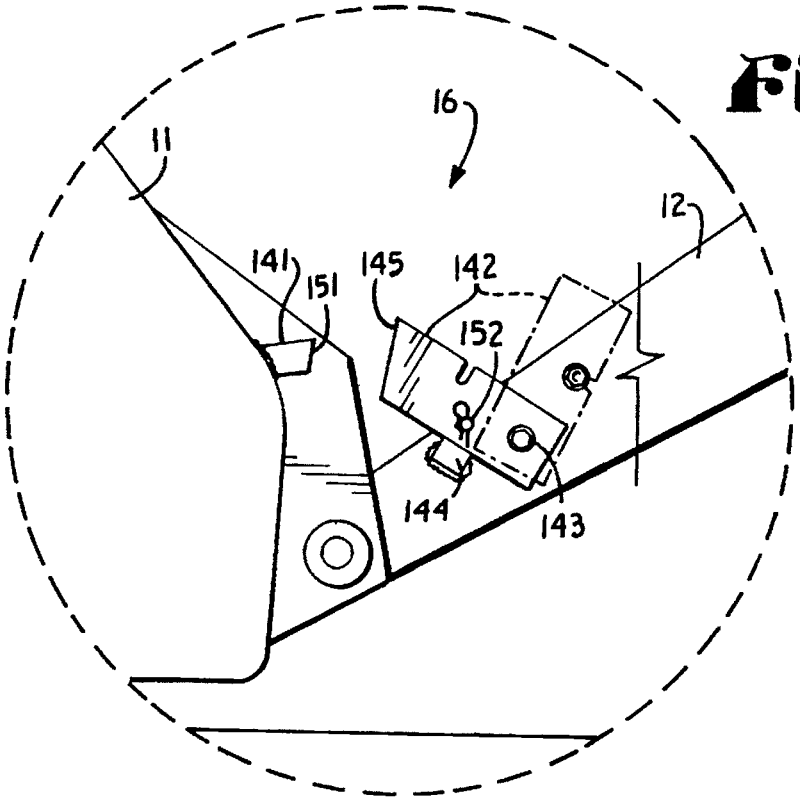
FIG. 9 is a greatly enlarged view of the area marked "9" and delineated in circular dotted lines in FIG. 1, illustrating a side elevational view of a pivotable front bucket support stop attached to the front bucket support boom.

Referring to FIG. 9, a fixed stop block 141 is welded to the rear of the front bucket 11. A mating movable stop block 142 is pivotably attached to the top of the front bucket boom 12 via a pivot pin 143. A support block 144 is welded to the front boom 12 in a position to support the pivotable stop block 142 in a forward position, as shown in solid lines in FIG. 9. The stop block 142 has a front face 145 which is angled to mate with an angled face 151 on the fixed stop block 141 when the bucket is in a level, support position. A pin 152 which is insertable within a bore (not shown) in the front boom 12 is provided to hold the block 142 in the forward position. When the apparatus 1 is removed from the railroad car 2 and is to be used for other purposes, the pin 152 is removed and the pivotable block 142 is pivoted backward to the position shown in phantom lines in FIG. 9. In this position, the front bucket 11 has total freedom of movement and can be used for earth moving or other, similar tasks.

V. Second Alternative Embodiment of Center Support Feet

Figure 11:
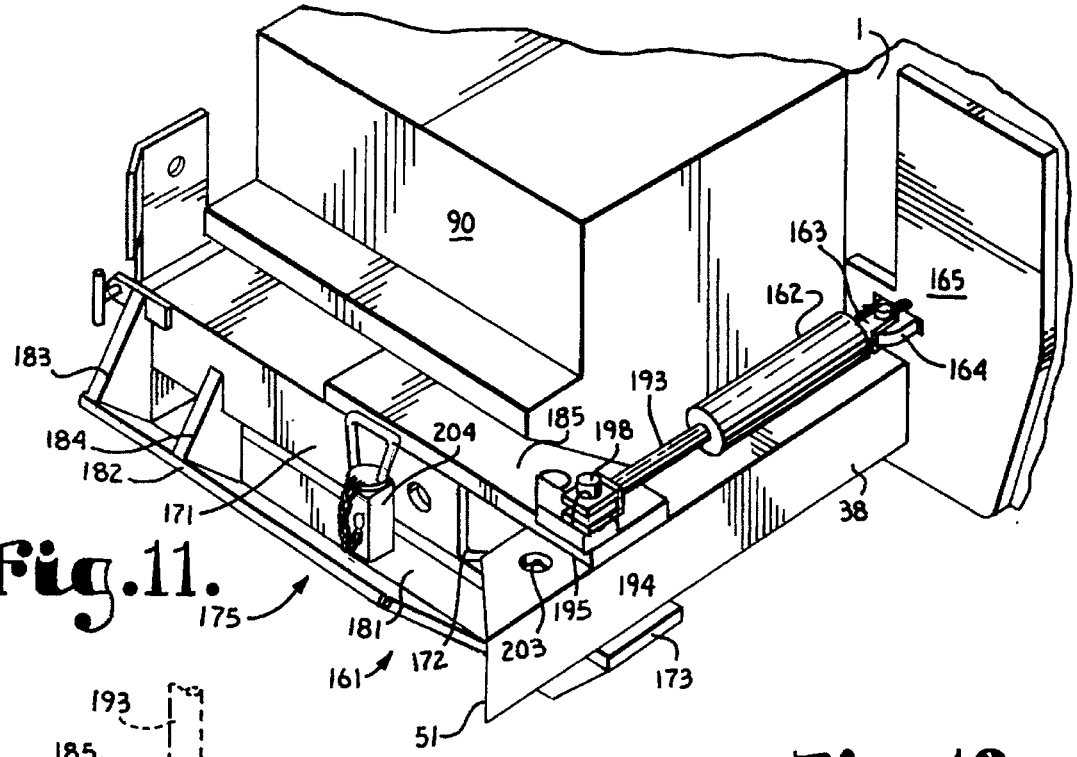
FIG. 11 is an enlarged, fragmentary, perspective view of a second alternative embodiment of a right center support foot with the support foot being selectively extendable and retractable via a hydraulic piston and cylinder unit, with the support foot shown in a retracted position and with the piston and cylinder unit shown in an extended position.
Figure 13:
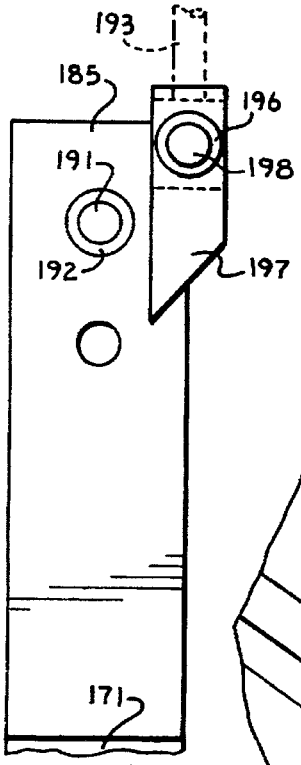
FIG. 13 is a greatly enlarged, fragmentary top plan view of a portion of the extendable center foot of FIG. 12, taken along the line 12—12 of FIG. 12, and illustrating the eccentric attachment of the piston and cylinder unit to the pivoting foot.
Figure 12:
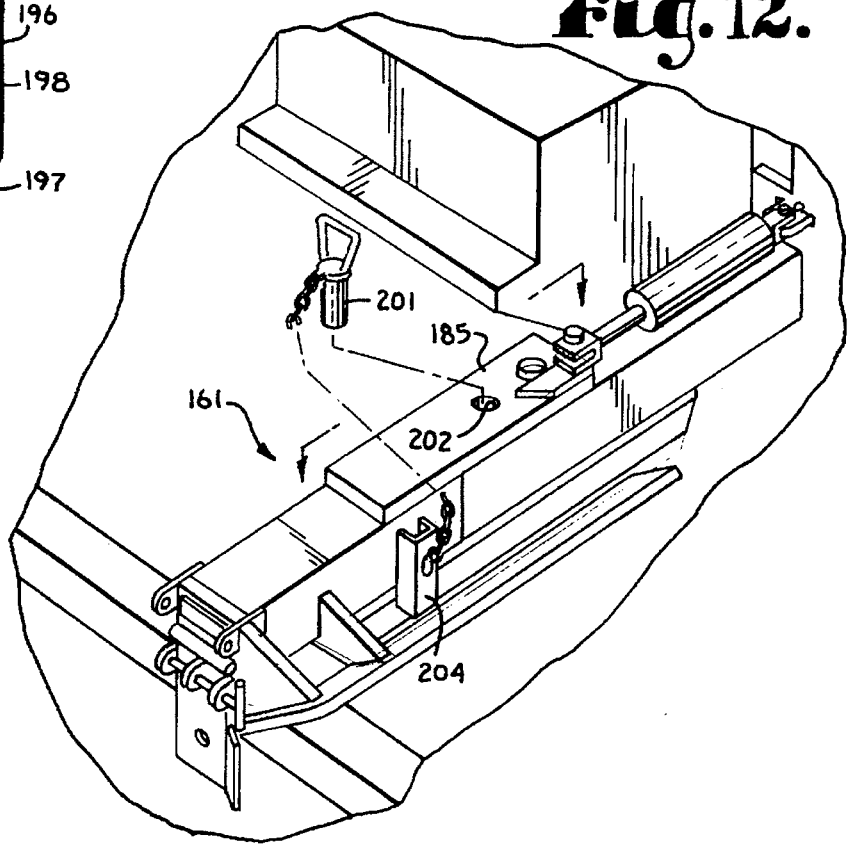
FIG. 12 is an enlarged, fragmentary, perspective view of the right center support foot of FIG. 11, with the support foot shown in an extended position and with the piston and cylinder unit shown in a retracted position and with a locking pin being inserted to lock the foot in the extended position.

Referring to FIGS. 11–13, a second alternative embodiment of center support foot is indicated generally with the numeral 161, it being understood again, that there are right and left mirror image support feet 161 on the apparatus 1. The support foot 161 differs from the support feet 42 of FIG. 2–5 in the provision of a double action hydraulic piston and cylinder unit 162 which is connected at a first end 163 to a clevis 164 mounted on a rigid support plate 165 which plate 165 is welded or otherwise rigidly attached to the side of the apparatus 1. For simplicity of illustration, no hydraulic lines are shown connected to the piston and cylinder unit 162, it being understood that conventional hydraulic lines are attached to either end of a cylinder portion 166.

Similar to the support feet 42, each center support foot 161 includes a square steel tube 171 which is the same dimensions in cross-section as the center support beam 38. Each tube 171 has an end 172 which is also beveled at a 45 degree angle to mate with the respective beveled end 51 of the center beam 38. A bottom plate 173 extends along the length of and past the tube 171, with the plate 173 being welded to the tube 171. A skid plate 175 is attached beneath the bottom plate 174 with each skid plate 175 including a flat center portion 181 and a pair of angled wing portions 182. Skid reinforcing plates 183 and 184 extend upward between the skid plate 175 and the tube 171 to provide enhanced support for the skid plate 175.

Each center support foot 161 includes an upper pivot plate 185 which is attached to the top of and extends past the beveled end 172 of the respective tube 171. A pivot pin 191 extends vertically through a reinforced bore 192 in each pivot plate 185, through a vertical bore (not shown) in the center support beam 38 and into the respective rectangular bottom plate 173. Each support foot 161 is thus pivotably attached to a respective end of the center support beam 38 via the respective pivot pin 191.

The hydraulic piston and cylinder unit 162 has a selectively extendable piston rod 193 which terminates in a U shaped bracket 194 with a vertically extending bore 195 extending therethrough. The bore 195 is aligned with a bore 196 in a beveled pivot plate 197. The pivot plate 197 is attached to one side of the upper pivot plate 185 and a pivot pin 198 extends through the bore 195 in the U shaped bracket and into the bore 196 in the plate 197. The bores 195 and 196 and the pivot pin 198 collectively provide an offset pivot point. Thus, the piston rod 193 is thus pivotally attached to the upper pivot plate 185, but in an offset position such that the piston rod attachment is eccentric with respect to the pivot pin 191.

In operation, each of the center support feet 161 are selectively movable between a retracted position, as shown in FIG. 11, and an extended position, as shown in FIG. 12. In the retracted position, each respective support foot 161 extends approximately parallel to the chassis 3 and partially underlies a step 90. In this position, the piston and cylinder unit 162 is extended, causing the eccentrically mounted piston rod 193 to rotate the arm 161 inward to the position of FIG. 11. When the machine 1 is to be used atop a railroad car, such as the car 2 in FIG. 1, the piston and cylinder units 162 are retracted, with each eccentrically mounted piston rod 193 causing the foot 161 to rotate outward to the position of FIG. 12. A pin 201 is then inserted into a bore 202 in the upper plate 185 and a mating bore 203 in the center beam 38 to thus lock the arm 161 in the extended position. It should be noted that the locking ears 71 of the foot 42 are eliminated in the embodiment of FIGS. 11–13 since the piston and cylinder unit 162 also performs a locking or holding function. A pin holder 204 is provided on the center support foot 161 for storing the locking pin 201 when not in use.

While the center feet 161 are shown with skids 175, they can be equipped with rollers such as the roller 93 in FIGS. 6 and 7.

It is to be understood that while certain forms of the present invention have been illustrated and described herein, it is not to be limited to the specific forms or arrangement of parts described and shown.

What is claimed and desired to be secured by Letters Patent is as follows:

1. A mobile apparatus for loading and unloading an open top railroad car having spaced, parallel sidewalls with upper surfaces, said apparatus comprising:

(a) a mobile, powered apparatus having front and rear ends and front and rear wheels attached to a chassis such that said apparatus is movable over a ground surface;

(b) a power actuated front boom structure pivotally mounted at said apparatus front end, said front boom structure being of a length to reach below ground surface when said apparatus is positioned on the ground surface for elevating said front wheels above said ground surface and including a front support foot member having surfaces engageable with said side wall upper surfaces for supporting said apparatus front end thereon and including lateral movement limiting vertical plate members extending therefrom and engageable with side surfaces of said sidewalls;

(c) power actuated, outwardly swingable outrigger arms pivotally connected adjacent to said apparatus rear end and movable toward said side wall upper surfaces, said outrigger arms including free ends having rear support foot members engageable with said side wall upper surfaces for supporting said apparatus rear end thereon;

(d) a center support beam extending transversely across and attached beneath said powered apparatus between said front and rear wheels;

(e) a pair of center support feet, with one of said center support feet attached near each respective end of said center support beam at a pivot point centered with respect to the width of said center support beam, each of said center support feet being pivotably movable in a horizontal plane relative to said center support beam between a retracted position in which the support foot is oriented at approximately 90 degrees to said center support beam, and an extended position in which the support foot is oriented approximately in line with said center support beam, said center support feet having surfaces engageable with said side wall upper surfaces when in said extended position;

(f) a pair of power extension mechanisms for selectively moving respective ones of said center support feet between said extended and said retracted positions; and (g) a power actuated rear boom structure pivotally mounted at said apparatus rear end and being of a combined length to reach the ground surface when said apparatus is positioned on the upper surfaces of said sidewalls, said rear boom structure having respective arm lengths with a material engaging device connected thereto and operable to handle materials for loading and unloading operations relative to said railroad car when said apparatus is positioned upon the upper surfaces of the railroad car sidewalls.

2. The apparatus set forth in claim 1, wherein each of said power extension mechanisms comprises:

(a) a pivot point on each respective center support foot, said pivot point being offset with respect to said centered pivot point; and (b) a hydraulic piston and cylinder unit with a first end pivotably connected to the chassis and with a second end pivotably connected to said offset pivot point.

3. The apparatus set forth in claim 2, wherein each said center foot comprises:

(a) a beam section;

(b) a top and a bottom plate, both of which are connected to and which extend past said beam section, said top and bottom plates overlapping an end of said center beam and being connected to said center beam at said center pivot point; and (c) said offset pivot point being connected to said top plate forward of said center pivot point.

4. A mobile apparatus for loading and unloading an open top railroad car having spaced, parallel sidewalls with upper surfaces, said apparatus comprising:

(a) a mobile, powered apparatus having front and rear ends and front and rear wheels attached to a chassis such that said apparatus is movable over a ground surface;

(b) a power actuated front boom structure pivotally mounted at said apparatus front end, said front boom structure being of a length to reach below ground surface when said apparatus is positioned on the ground surface for elevating said front wheels above said ground surface and including a front support foot member having surfaces engageable with said side wall upper surfaces for supporting said apparatus front end thereon and including lateral movement limiting vertical plate members extending therefrom and engageable with side surfaces of said sidewalls;

(c) power actuated, outwardly swingable outrigger arms pivotally connected adjacent to said apparatus rear end and movable toward said side wall upper surfaces, said outrigger arms including free ends having rear support foot members engageable with said side wall upper surfaces for supporting said apparatus rear end thereon;

(d) a center support beam extending transversely across and attached beneath said powered apparatus between said front and rear wheels;

(e) a pair of center support feet, with one of said center support feet pivotably attached to each respective end of said center support beam, each of said center support feet being movable between a retracted position in which the support foot is oriented at approximately 90 degrees to said center support beam, and an extended position in which the support foot is oriented approximately in line with said center support beam, said center support feet having surfaces engageable with said side wall upper surfaces when in said extended position, each said center support foot including a support roller positioned to contact said upper surface of said railroad car sidewall when said center support feet are in said extended position;

(f) a pair of power extension mechanisms for selectively moving respective ones of said center support feet between said extended and said retracted positions; and (g) a power actuated rear boom structure pivotally mounted at said apparatus rear end and being of a combined length to reach the ground surface when said apparatus is positioned on the upper surfaces of said sidewalls, said rear boom structure having respective arm lengths with a material engaging device connected thereto and operable to handle materials for loading and unloading operations relative to said railroad car when said apparatus is positioned upon the upper surfaces of the railroad car sidewalls.

5. The apparatus set forth in claim 4, wherein each of said power extension mechanisms comprises:

(a) a pivot point on each respective center support foot, said pivot point being offset with respect to said centered pivot point; and (b) a hydraulic piston and cylinder unit with a first end pivotably connected to the chassis and with a second end pivotably connected to said offset pivot point.

6. The apparatus set forth in claim 4, wherein each said center foot comprises:

(a) a beam section;

(b) a top and a bottom plate, both of which are connected to and which extend past said beam section, said top and bottom plates overlapping an end of said center beam and being connected to said center beam at said center pivot point; and (c) said offset pivot point being connected to said top plate forward of said center pivot point.

7. A mobile apparatus for loading and unloading an open top railroad car having spaced, parallel sidewalls with upper surfaces, said apparatus comprising:

(a) a mobile, powered apparatus having front and rear ends and front and rear wheels attached to a chassis such that said apparatus is movable over a ground surface;

(b) a power actuated front boom structure pivotally mounted at said apparatus front end, said front boom structure being of a length to reach below ground surface when said apparatus is positioned on the ground surface for elevating said front wheels above said ground surface;

(c) a powered bucket pivotably attached to said front boom structure;

(d) a pair of front support foot members having surfaces engageable with said side wall upper surfaces for supporting said apparatus front end thereon and including lateral movement limiting vertical plate members extending therefrom and engageable with side surfaces of said sidewalls, one such front foot member being attached to each side of said front bucket, each said front support foot member including:

(i) a skid including a substantially flat center support portion and at least one angled wing portion;

(ii) a support roller positioned within said angled wing portion, said support rollers selectively contacting said upper surfaces of said railroad car sidewalls when said front bucket is pivoted to a first predetermined angle and said center support section contacting said upper surfaces of said railroad car sidewalls when said bucket is pivoted to a second predetermined angle;

(e) power actuated, outwardly swingable outrigger arms pivotally connected adjacent to said apparatus rear end and movable toward said side wall upper surfaces, said outrigger arms including free ends having rear support foot members engageable with said side wall upper surfaces for supporting said apparatus rear end thereon;

(f) a center support beam extending transversely across and attached beneath said powered apparatus between said front and rear wheels;

(g) a pair of center support feet, with one of said center support feet pivotably attached to each respective end of said center support beam, each of said center support feet being movable between a retracted position in which the support foot is oriented at approximately 90 degrees to said center support beam, and an extended position in which the support foot is oriented approximately in line with said center support beam, said center support feet having surfaces engageable with said side wall upper surfaces when in said extended position;

(h) a pair of power extension mechanisms for selectively moving respective ones of said center support feet between said extended and said retracted positions; and (i) a power actuated rear boom structure pivotally mounted at said apparatus rear end and being of a combined length to reach the ground surface when said apparatus is positioned on the upper surfaces of said sidewalls, said rear boom structure having respective arm lengths with a material engaging device connected thereto and operable to handle materials for loading and unloading operations relative to said railroad car when said apparatus is positioned upon the upper surfaces of the railroad car sidewalls.

8. The apparatus set forth in claim 7, wherein each of said power extension mechanisms comprises:

(a) a pivot point on each respective center support foot, said pivot point being offset with respect to said centered pivot point; and (b) a hydraulic piston and cylinder unit with a first end pivotably connected to the chassis and with a second end pivotably connected to said offset pivot point.

9. The apparatus set forth in claim 8, wherein each said center foot comprises:

(a) a beam section;

(b) a top and a bottom plate, both of which are connected to and which extend past said beam section, said top and bottom plates overlapping an end of said center beam and being connected to said center beam at said center pivot point; and (c) said offset pivot point being connected to said top plate forward of said center pivot point.

10. A mobile apparatus for loading and unloading an open top railroad car having spaced, parallel sidewalls with upper surfaces, said apparatus comprising:

(a) a mobile, powered apparatus having front and rear ends and front and rear wheels attached to a chassis such that said apparatus is movable over a ground surface;

(b) a power actuated front boom structure pivotally mounted at said apparatus front end, said front boom structure being of a length to reach below ground surface when said apparatus is positioned on the ground surface for elevating said front wheels above said ground surface and including a front support foot member having surfaces engageable with said side wall upper surfaces for supporting said apparatus front end thereon and including lateral movement limiting vertical plate members extending therefrom and engageable with side surfaces of said sidewalls;

(c) power actuated, outwardly swingable outrigger arms pivotally connected adjacent to said apparatus rear end and movable toward said side wall upper surfaces, said outrigger arms including free ends having rear support foot members engageable with said side wall upper surfaces for supporting said apparatus rear end thereon;

(d) a center support beam extending transversely across and attached beneath said powered apparatus between said front and rear wheels;

(e) a pair of center support feet, with one of said center support feet pivotably attached to each respective end of said center support beam, each of said center support feet being movable between a retracted position in which the support foot is oriented at approximately 90 degrees to said center support beam, and an extended position in which the support foot is oriented approximately in line with said center support beam, said center support feet having surfaces engageable with said side wall upper surfaces when in said extended position;

(f) a pair of power extension mechanisms for selectively moving respective ones of said center support feet between said extended and said retracted positions;

(g) a power actuated rear boom structure pivotally mounted at said apparatus rear end and being of a combined length to reach the ground surface when said apparatus is positioned on the upper surfaces of said sidewalls, said rear boom structure having respective arm lengths with a material engaging device connected thereto and operable to handle materials for loading and unloading operations relative to said railroad car when said apparatus is positioned upon the upper surfaces of the railroad car sidewalls;

(h) a powered bucket pivotably attached to said front boom structure; and (i) a movable bucket stop block attached to said front boom structure, said movable bucket stop block being selectively movable between a bucket supporting position which restricts the movement of said bucket for use during railroad car loading and unloading operations and a retracted, nonsupporting position which permits said bucket to be freely moved and thus to be used for purposes other than railroad car loading and unloading.

11. The apparatus set forth in claim 10, wherein each of said power extension mechanisms comprises:

(a) a pivot point on each respective center support foot, said pivot point being offset with respect to said centered pivot point; and (b) a hydraulic piston and cylinder unit with a first end pivotably connected to the chassis and with a second end pivotably connected to said offset pivot point.

12. The apparatus set forth in claim 11, wherein each said center foot comprises:

(a) a beam section;

(b) a top and a bottom plate, both of which are connected to and which extend past said beam section, said top and bottom plates overlapping an end of said center beam and being connected to said center beam at said center pivot point; and (c) said offset pivot point being connected to said top plate forward of said center pivot point.

13. The apparatus set forth in claim 10 wherein there is a fixed bucket stop block attached to the rear of said bucket and positioned to cooperate with said movable stop block in said supporting position to support said bucket.

* * * * *